US006267554B1

(12) United States Patent
Heer

(10) Patent No.: US 6,267,554 B1
(45) Date of Patent: Jul. 31, 2001

(54) COOLING WATER PUMP

(75) Inventor: Siegfried Heer, Kirchdorf/Krems (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 0 days.

(21) Appl. No.: 09/406,143

(22) Filed: Sep. 27, 1999

(30) Foreign Application Priority Data

Sep. 28, 1998 (AT) ..... 1608/98

(51) Int. Cl.[7] ..... F04D 29/08

(52) U.S. Cl. ..... 415/170.1; 415/199.4; 417/423.12; 417/423.15

(58) Field of Search ..... 415/170.1, 199.5, 415/199.4; 417/423.12, 423.15, 423.1, 244; 123/41.44, 41.46

(56) References Cited

U.S. PATENT DOCUMENTS 1,370,823 3/1921 Krause .
4,067,665 * 1/1978 Schwartzman ..... 417/245
4,120,618 * 10/1978 Klaus ..... 417/420
4,479,756 * 10/1984 Sieghartner ..... 415/53 T
5,409,350 * 4/1995 Mitchell ..... 415/111
5,951,264 * 9/1999 Hori et al. ..... 417/360

FOREIGN PATENT DOCUMENTS 128755 3/1996 (AT) .
725762 8/1942 (DE) .
93483 11/1983 (EP) .

* cited by examiner

*Primary Examiner*—Edward K. Look
*Assistant Examiner*—James M McAleenan
(74) *Attorney, Agent, or Firm*—Dykema Gossett PLLC

(57) ABSTRACT

A high conveying capacity cooling water pump for an internal combustion engine includes a bearing element, a rotor which is held therein and carries three impellers, an inflow housing and an outflow housing. The outflow housing and the bearing element form a integral unit.

8 Claims, 2 Drawing Sheets

COOLING WATER PUMP

BACKGROUND OF THE INVENTION

The present invention relates to a cooling water pump with an internal rotor which is held in the housing and carries at least two impellers and with flow guide housings, namely an inflow housing and an outflow housing.

A number of boundary conditions must be observed in the design of cooling water pumps for internal combustion engines, particularly for motor vehicles. Such a cooling water pump must be simple in its design, cheap to produce and sufficiently sturdy in order to match the engine's service life without requiring any maintenance whatsoever. A further important criterion in the design of cooling water pumps is the restricted available installation space in modern motor vehicles. There is an additional problem in certain engines that high conveying quantities must be provided already at relatively low speeds. Moreover, the efficiency is to be as high as possible in order to reduce fuel consumption.

Usually, cooling water pumps are designed as radial centrifugal pumps whose dimensions are designed according to the volumes to be conveyed. Serious constructional problems can occur particularly when the outer diameter of the pump is limited.

DESCRIPTION OF THE PRIOR ART

A cooling water pump for an internal combustion engine is known from DE 725 762 C which is provided with a three-stage arrangement. Radial inflow and radial outflow of the cooling water is provided. A pump of such design requires a relatively large installation space and in many cases can therefore not be used. The same applies to a pump as is disclosed in U.S. Pat. No. 1,370,823 A for example.

SUMMARY OF THE INVENTION

It is the object of the present invention to provide a cooling water pump for an internal combustion engine which shows a high conveying quantity and conveying level already at relatively low speeds. In particular, the outside diameter of the pump is to be as small as possible.

This object is achieved in accordance with the invention that a bearing element is provided in which the rotor is held and which is used to fasten the cooling water pump and that a flow guide housing is integrally arranged with the bearing element. The cross-flow of the cooling water occurs substantially in the axial direction, even though the impellers are provided with a radially outwardly directed flow component. As a result of the preferably provided guide blades, the cooling water flow is directed radially inwardly so as to provide an optimal flow against the next following impeller. A particularly favorable constructional arrangement of the cooling water pump is given in the case that the pump is provided with a three-stage arrangement and two intermediate housings are provided between the inflow housing and the outflow housing. It is particularly preferable in this case if guide blades are provided which are fixedly connected with the intermediate housings.

In a particularly favorable embodiment of the present invention it is provided that the rotor is provided with a shaft stub held in an overhung arrangement to which the impellers are fastened. In this case the design is particularly simple and sturdy.

The cooling water pump in accordance with the invention can preferably be directly flanged onto the engine block or the cylinder head of the internal combustion engine when the bearing element is provided with a flanging surface which is parallel to the axis of the cooling water pump and the outflow opening is arranged in the flange surface. This leads to a particularly compact and secure design, because the number of sealing surfaces and connecting parts is minimized. The production costs can be reduced further by arranging the impellers as identical parts.

BRIEF DESCRIPTION OF THE DRAWINGS

The invention is now explained in closer detail by reference to the embodiment shown in the drawings, wherein.

DETAILED DESCRIPTION OF THE PREFERRED EMBODIMENTS

The cooling water pump in accordance with the invention consists of a bearing element 1, which is simultaneously arranged as an outflow housing, an inflow housing 2 and two intermediate housings 3 and 4 which are arranged between the bearing element 1 and the inflow housing 2. A plurality of screws 5 is used for connecting the aforementioned components.

Figure 1:
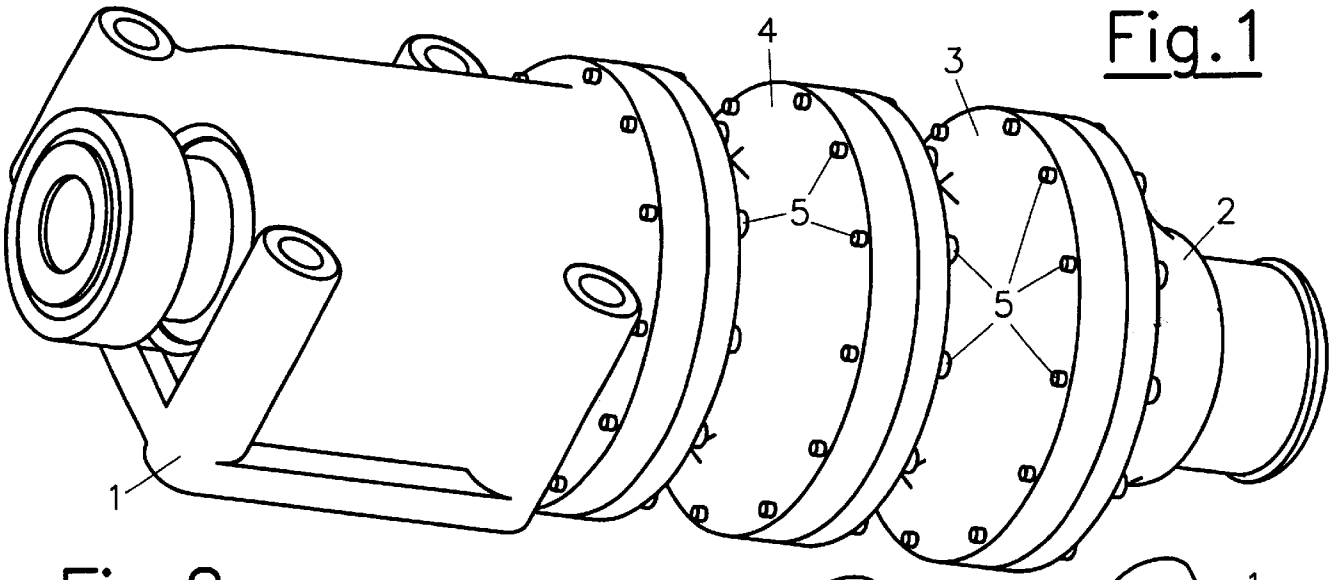
FIG. 1 shows an axonometric outside view of a cooling water pump in accordance with the invention.
Figure 2:
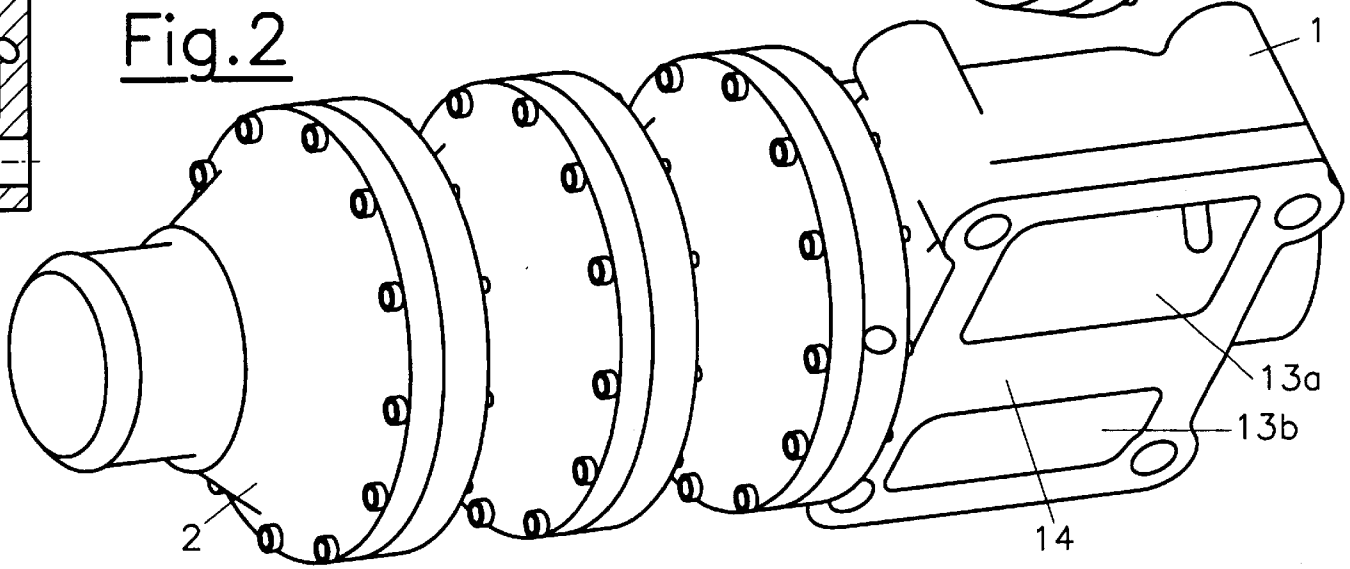
FIG. 2 shows an axonometric view of the cooling water pump obliquely from below.
Figure 4:
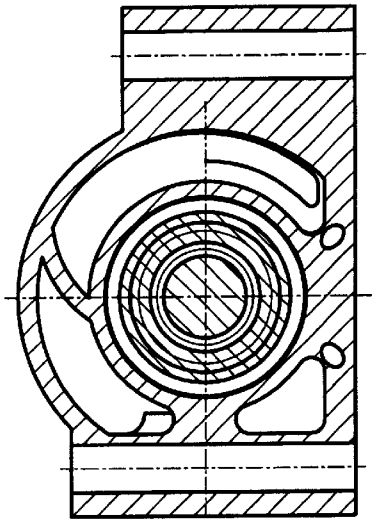
FIG. 4 shows a sectional view according to line 4—4 in FIG. 3.
Figure 3:
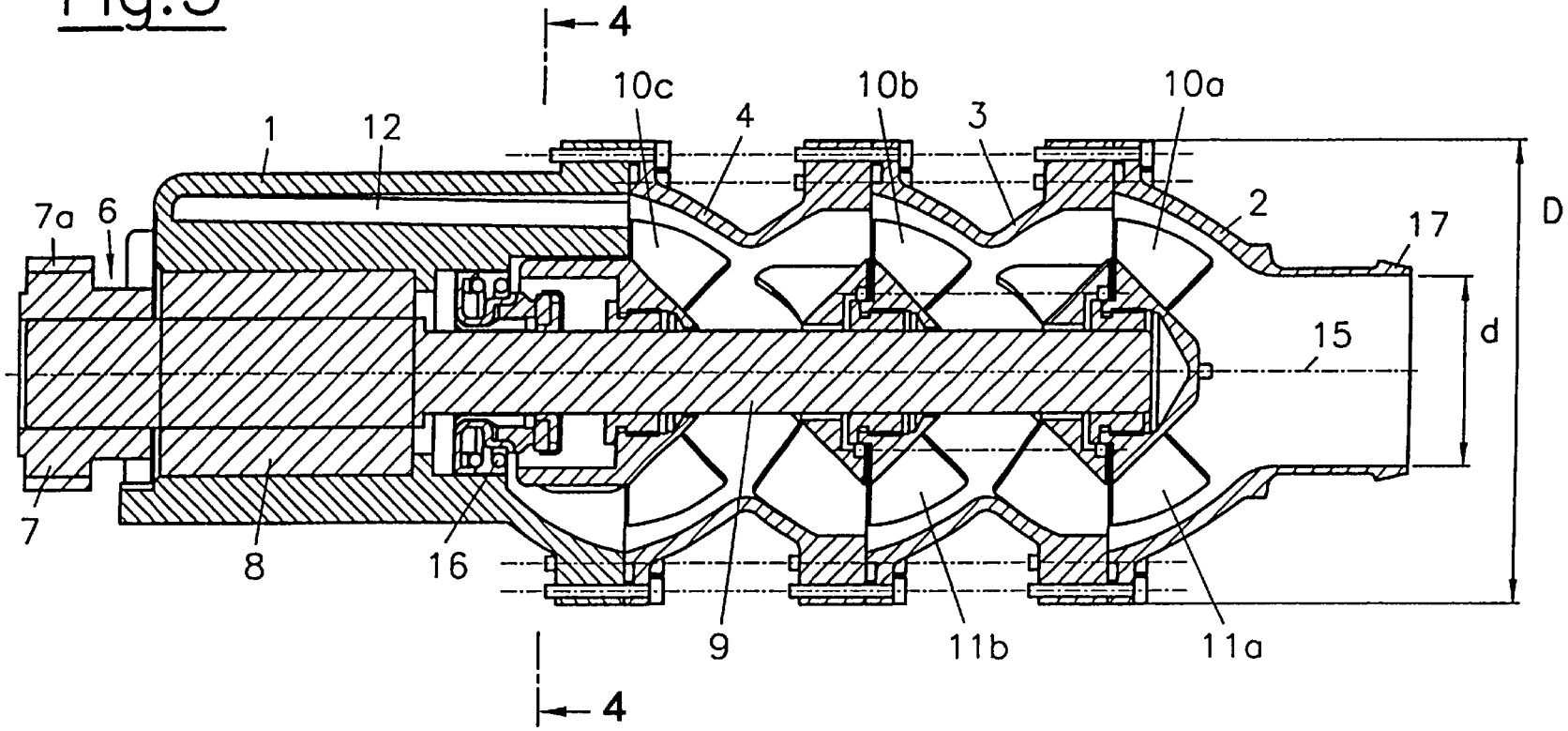
FIG. 3 shows a longitudinal sectional view of the cooling water pump.

FIG. 3 shows the arrangement of the cooling water pump in a detailed view. The rotor of the cooling water pump, which is generally designated with reference numeral 6, consists of a drive flange 7 which is provided on its outer circumference with a toothed wheel work 7*a* for the transmission of the driving torque, a bearing neck 8 which is held in bearing part 1 and a projecting shaft stub 9. Three constructionally identical impellers 10*a*, 10*b* and 10*c* are wedged up on the shaft stub 9 in equal axial intervals. Fixed guide blades 11*a* are arranged between the impellers 10*a* and 10*b*, which guide blades are fixedly connected with the intermediate housing 3. Guide blades 11*b* are similarly connected with the intermediate housing 4, which guide blades are arranged between the impellers 10*b* and 10*c*. An outlet worm 12 for the conveyed cooling water is provided which opens into the ports 13*a*, 13*b* which are arranged on a flange surface 14 in the bearing element 1. Flange surface 14 is parallel to axis 15 of the pump. An axial face seal 16 prevents the leakage of cooling water into the bearing 8. The interior diameter d of the suction nozzle 17 is approx. 45% of the outside diameter D of the pump. The impellers 10*a*, 10*b* and 10*c* and the guide blades 11*a* and 11*b* are each provided with a three-dimensionally curved arrangement. As a result of the consistent arrangement of the components as identical parts (intermediate housing 3 and 4, impellers 10*a*, 10*b*, 10*c* and guide blades 11*a*, 11*b*) the production costs can be kept very low.

The present invention allows producing a cooling water pump with a high conveying capacity with small outside dimensions.

I claim:

1. A cooling water pump for an internal combustion engine which comprises:

a housing, a rotor positioned in said housing, at least two impellers carried by said rotor, flow guide housings comprising an inflow housing and an outflow housing, and a bearing element in which the rotor is supported and which is adapted for fastening the cooling water pump, said bearing element being provided with a flange surface which is parallel to the axis of the cooling water pump and the outflow opening being formed in the flange surface, wherein said bearing element integral with the outflow housing which at least partially encompasses the bearing and wherein the rotor includes a shaft stub which is held in an overhung manner and to which the impellers are fastened.

2. A cooling water pump in accordance with claim 1, including fixed guide blades between two impellers each.

3. A cooling water pump in accordance with claim 1, including a three-stage arrangement and two intermediate housings between the inflow housing and the outflow housing.

4. A cooling water pump in accordance with claim 3, including guide blades fixedly connected with the intermediate housings.

5. A cooling water pump in accordance with claim 1, wherein the impellers are identical parts.

6. A cooling water pump in accordance with claim 1, wherein the interior diameter of the suction opening is between 40% and 60% of the outside diameter of the cooling water pump.

7. A cooling water pump in accordance with claim 1, wherein the outflow housing at least partially encompasses the bearing of the rotor.

8. A cooling water pump for an internal combustion engine which comprises:

an inflow housing;

an outflow housing, said outflow housing defining an internal bearing, a flange surface that provides a cooling water outlet port, and a flow channel which at least partly extends around said internal bearing and communicates with said outlet port, an two intermediate housing positioned between said inflow housing and said outflow housing, and an elongated rotor which is rotatably mounted in said bearing and extends in cantilever fashion through said intermediate housing toward said inflow housing, said rotor defining an axis of said pump and mounting two impellers for conveying cooling water through said pump from said inflow housing to said outlet port, said surface flange extending in parallel with said axis.

* * * * *